US006560941B1

(12) United States Patent
French

(10) Patent No.: US 6,560,941 B1
(45) Date of Patent: May 13, 2003

(54) MULTI-COMPONENT WINDOW SHUTTER SYSTEM

(75) Inventor: Nicholas A. French, Douglas, MI (US)

(73) Assignee: Pinckney Molded Plastics, Inc., Howell, MI (US)

( * ) Notice: Subject to any disclaimer, the term of this patent is extended or adjusted under 35 U.S.C. 154(b) by 0 days.

(21) Appl. No.: 09/723,177

(22) Filed: Nov. 27, 2000

Related U.S. Application Data

(60) Provisional application No. 60/180,650, filed on Feb. 7, 2000.

(51) Int. Cl.[7] ..... E06B 7/08
(52) U.S. Cl. ..... 52/473; 52/745.19; 52/473
(58) Field of Search ..... 52/473, 455, 475.1, 52/457, 458, 784.13

(56) References Cited

U.S. PATENT DOCUMENTS 3,584,427 A * 6/1971 Johnstorn ..... 52/473
4,858,400 A * 8/1989 Foyt ..... 52/98
4,939,880 A 7/1990 Wang
5,152,116 A 10/1992 MacGowan
5,347,782 A 9/1994 Vagedes
5,430,986 A 7/1995 Vagedes
5,704,182 A 1/1998 Schiedegger
5,761,865 A 6/1998 Schiedegger et al.
5,782,052 A * 7/1998 Lacy ..... 52/473
5,826,393 A * 10/1998 Wenzlaff et al. ..... 52/473
5,924,255 A 7/1999 Vagedes
6,141,938 A * 11/2000 Schiedegger ..... 52/745.19

* cited by examiner

*Primary Examiner*—Carl D. Friedman
*Assistant Examiner*—Steve Varner
(74) *Attorney, Agent, or Firm*—Young & Basile, P.C.

(57) ABSTRACT

A multi-component shutter assembly for the production of decorative shutters having a nearly infinite variety of different combinations of louvered sections and raised panel sections with a greatly reduced tooling cost. The shutter system includes a base shutter having a perimeter frame and transverse louvers along its length, and a set of elements which are attachable to the base shutter. The elements are manufactured in a wide variety of different sizes, styles, and colors, and any one or more of the elements can be attached to the base shutter at any desired location along its length to produce a shutter assembly of the desired appearance. The elements can be fastened to the front of the base shutter to cover the louvers at that location, or some or all of the louvers of the base shutter can be cut away and removed to form an aperture and the element fastened to the base shutter to cover the aperture.

15 Claims, 4 Drawing Sheets

MULTI-COMPONENT WINDOW SHUTTER SYSTEM

This application claims the benefit of No. 60/180,650 filed Feb. 7, 2000.

FIELD OF THE INVENTION

This invention relates to shutter assemblies for mounting on exterior walls of buildings, adjacent to windows. More specifically, the invention relates to a multi-component shutter assembly that provides a wide variety of shutter configurations that can be assembled from a few basic components.

BACKGROUND OF THE INVENTION

Simulated window shutters are often used on residential and commercial buildings for aesthetic purposes. Most of these shutters are made of thermoformed or injection molded plastic. Shutters can be produced in a variety of different styles, the most popular of which is the louvered shutter. A louvered shutter has a relatively narrow frame and horizontal slats over most of its length. Sometimes a horizontal mullion is positioned at or near the vertical midpoint of the shutter to divide it into upper and lower louvered sections. A mullion generally has the same width as, and appearance of, the frame.

The raised panel shutter is less popular than the louvered shutter, but is also sold in significant quantities. A raised panel shutter has a perimeter frame and at least one generally flat central panel spaced from the frame by a recessed channel. As with the louvered shutter, a horizontal mullion sometimes divides the central panel into upper and lower sections.

Another shutter design is the "combination" shutter having both louvered and raised panel sections on a single shutter. A combination shutter can have more than one raised panel section, and/or more than one louvered panel section if desired. The louvered sections and panel sections can be positioned at any location along the length of the shutter to achieve the desired appearance.

An infinite variety of shutters can be conceived. However, prior to the current invention, the variations of shutters manufactured was limited due to high tooling costs. Typically, each shutter requires the construction of specialized tooling. Now, the present invention provides a solution to this problem. The present invention provides a shutter assembly made of multiple, interchangeable components that can produce an infinite variety of shutter assemblies.

SUMMARY OF THE INVENTION

The present invention provides a shutter assembly having at least one louvered section and at least one raised panel section. The shutter assembly includes two components, the base shutter and a panel element. The base shutter, in turn, includes two components, a frame and louvers. A plurality of louvers are positioned along the length of the frame, each louver extending transversely across the width of the frame. The second component of the shutter assembly is a panel element that is securable to the base shutter. After securing, the panel element is thus the raised panel section. The present invention can be practiced with a panel element that is substantially longer than the width of the frame. Such a panel element is noticeably different from a mullion. The present invention can be practiced with a base shutter that is integrally molded. In such a base shutter, the louvers and the frame are formed together as a single unitary piece, preferably by a plastic injection molding process. The plastic molded, unitary base shutter is suitable for use with, or without, one or more of the panel elements.

The securing of the panel element on the base shutter can be accomplished through the use of a projection extending from the panel element. The projection will engage the base shutter in any one of several ways. The projection can fit between the louvers during the securing of the panel element and create a snap fit on a louver. The present invention can also be practiced wherein the projection is cylindrical shaped. In such an embodiment, the frame of the base shutter includes at least one aperture. The panel element is secured to the base shutter when the projection is inserted into the aperture. The insertion of the projection can create a snap fit or, alternatively, the projection can be thermally deformed or engaged with a separate fastener.

In another embodiment of the present invention, louvers can be removed from the base shutter to facilitate the securing of the panel element. Removal of a quantity of louvers will create a gap in the base shutter. The panel element is inserted in this gap from the rear side of the base shutter. Securing of the panel element can be accomplished by several alternative means. In one embodiment, the frame includes at least one stake extending from the rear side of the frame. In this embodiment, the panel element includes at least one aperture. The stake located on the frame is inserted into the aperture located on the panel element. The insertion can form a snap fit or the stake can be thermally deformed after insertion or a separate fastener can be provided. Another embodiment of the invention requires that the panel element include a lip. The lip can extend a sufficient distance from the panel element to ensure that the panel element will not be capable of insertion completely through the gap in the base shutter. In such an embodiment the panel element can be secured to the base shutter by a snap fit or by adhesive placed along the lip of the panel element and then mating the panel element with the front or rear side of the frame, or by ultrasonic spot welding of the panel to the base shutter. The present invention can also be practiced with a panel element that includes a lip. Further, the panel element can be secured to the front or rear of the base shutter with the use of adhesives placed on the lip, or by ultrasonic spot welding of the panel to the base shutter. The present invention also teaches a method of constructing a shutter assembly. A base shutter having a frame and louvers is provided. Also, a set of panel elements of different sizes and appearances from the base shutter is provided. At least one panel element of the set can be selected for attachment to the base shutter. Finally, the selected element is secured to the base shutter at a desired location. This method is capable of producing an infinite variety of shutter assemblies. The method taught by the present invention can be practiced with a panel element that is substantially longer than the width of the frame. The method of the present invention can also be practiced with a panel element including at least one projection extending from a rear surface. The panel element can be secured by the projection. The method of the present invention can also be practiced by forming a gap in the base shutter and inserting the panel element through the gap. This method allows production of one plastic molded, louvered base shutter, which can be modified as required to produce different external appearances to meet current consumer demands without extensive retooling of production equipment.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
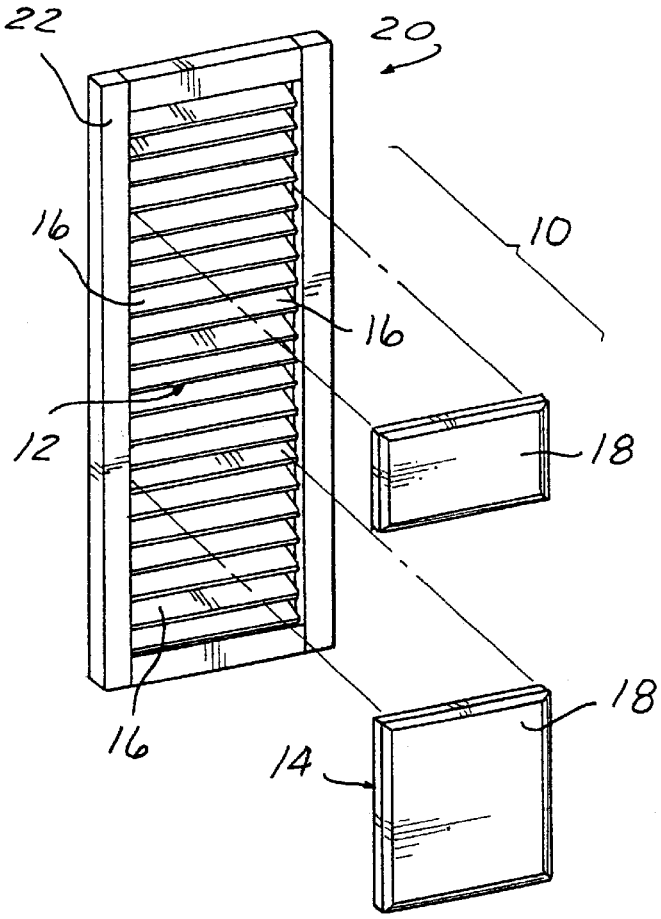
FIG. 1 is an exploded view of a shutter assembly according to a first embodiment of the present invention wherein elements are attached over louvers of a base shutter.
Figure 2:
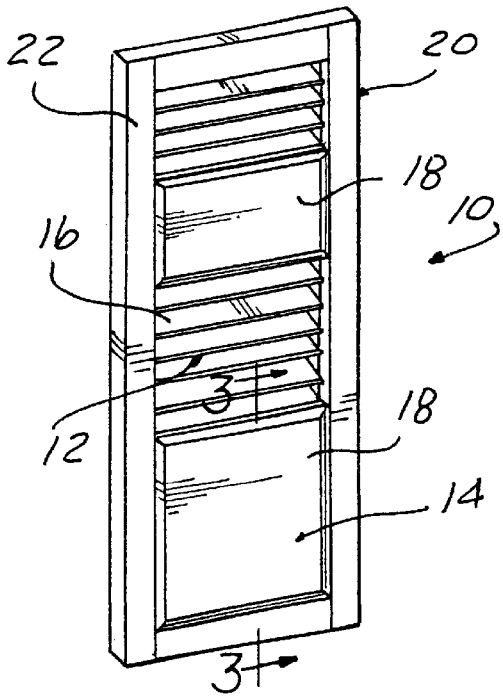
FIG. 2 is an assembly view of the shutter assembly of FIG. 1.

The present invention provides a shutter assembly 10 having at least one louvered section 12 and at least one raised panel section 14. As used herein, a "louvered section" refers to an area of the shutter assembly where the space between two lengths of the frame is occupied by one or more louvers 16. In FIGS. 1 and 2, a louvered section 12 is shown with one or more louvers 16. As used herein, a "raised panel section" refers to an area of the shutter assembly where the space between two lengths of frame is occupied by a panel element. A raised panel section 14 is shown in FIGS. 1 and 2 with at least one panel element 18.

The shutter assembly 10 includes a base shutter 20 and a panel element 18. As shown in FIG. 1, base shutter 20 includes a frame 22 having longitudinally extending elongated frame portions and transversely extending frame portions forming a peripheral portion of the assembly, and a plurality of transversely extending louvers 16. Preferably, the base shutter 20 is formed of plastic by an injection molding process. The frame 22 and louvers 16 are preferably integrally molded into a single unitary piece. Base shutter 20 can be produced in different lengths and widths, sizes and shapes, to suite a wide variety of window sizes and a wide variety of colors, and preferably is suitable for use independent of the panel elements.

FIG. 1 shows a rectangular shaped base shutter 20. However, shutters having half round or quarter round upper sections are well known in the art and are within the scope of the present invention. Furthermore, it is well known in the art to produce shutters that incorporate mullions that function to divide the shutter into two or more sections. Mullions are typically the same width as the frame 22. Shutters incorporating mullions are within the scope of the present invention.

The shutter assembly of the present invention also incorporates a panel element 18. Panel element 18 is preferably made of plastic and can be formed by injection molding or thermal forming. One or more panel elements 18 can be attached to base shutter 20 at desired locations along the length of the frame 22. Ideally, panel element 18 can be manufactured in a variety of lengths and widths, sizes and shapes, styles and colors so that an infinite variety of shutter assemblies can be constructed.

Figure 3:
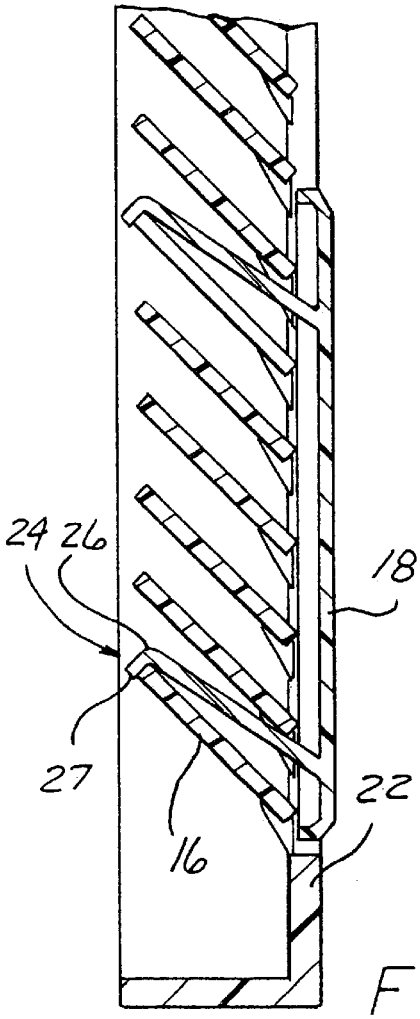
FIG. 3 is a cross-sectional view taken along line 3—3 of FIG. 2.

The panel element 18 is secured to the base shutter 20 to form the shutter assembly 10. The securing of the panel element 18 can be accomplished in several ways. Creating a shutter assembly 10 in this manner allows for maximum flexibility in creating a great variety of shutters, while, at the same time, limiting tooling expense in the production of shutter assemblies 10. In one embodiment of the present invention, the panel element 18 is secured to the base shutter 20 through the use of a projection 24. FIG. 3 shows one example of a projection 24 that is within the scope of the present invention. The projection 24 extends from a rear surface of the panel element 18. As used herein, "rear surface" refers to the side of the panel element 18 that is hidden from view when the shutter assembly 10 is mounted next to a window. In FIG. 3 the projection 24 takes the form of a retainer 26. The retainer 26 extends from the rear surface of panel element 18 in between louvers 16 and connects to at least one louver 16. A snap fit edge 27 can be formed on the retainer 26 to operably engage a rear surface of the louver 16 to hold the panel element 18 securely to the frame 22.

Figure 8:
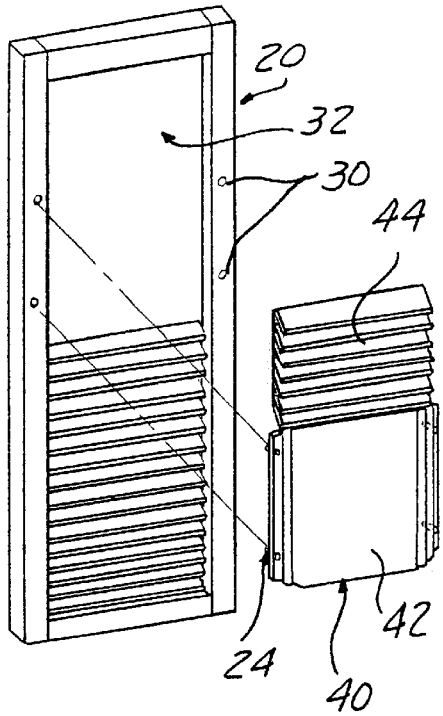
FIG. 8 is an exploded view of an embodiment of the invention wherein a combination louver/panel element is attached to the base shutter by stakes formed on the element.
Figure 9:
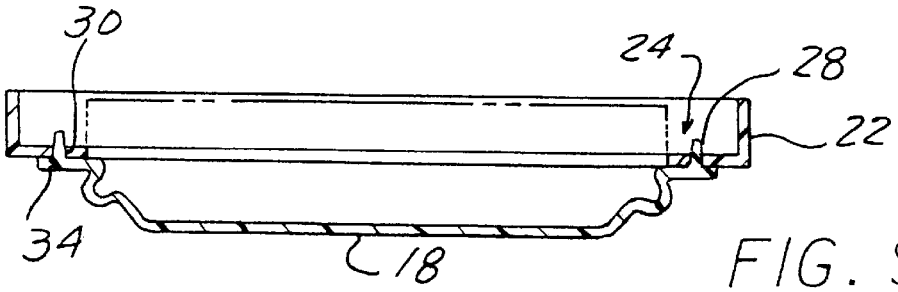
FIG. 9 is a cross-sectional view of the shutter assembly of FIG. 8.
Figure 10:
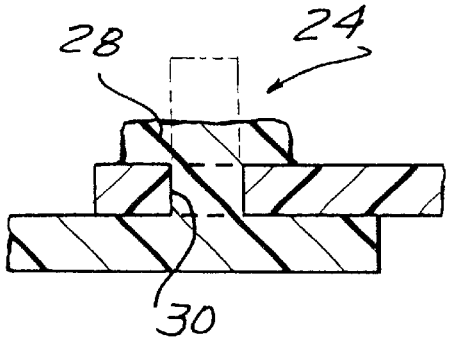
FIG. 10 is a cross-sectional view of the shutter assembly showing the engagement of the panel element and the base shutter with a heat stake.
Figure 11:
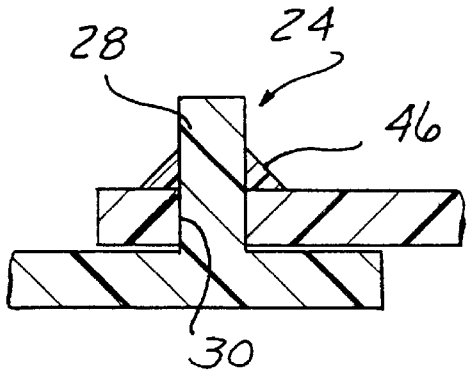
FIG. 11 is a cross-sectional view of the shutter assembly showing the engagement of the panel element and the base shutter with a fastener.
Figure 13:
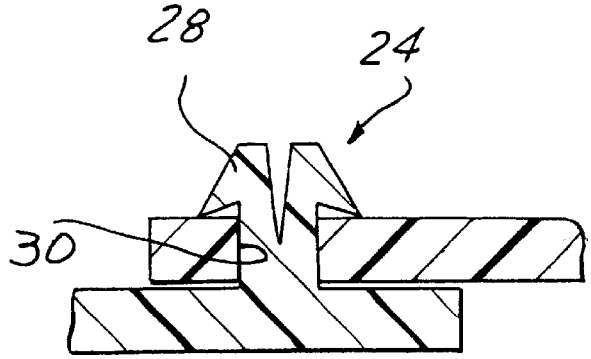
FIG. 13 is a cross-sectional view of the shutter assembly showing the engagement of the panel element and the base shutter with a snap fit arrangement.

In FIG. 9 an alternative form of projection 24 is shown. The projection 24 takes the form of a stake 28. In this embodiment of the present invention, frame 22 includes an aperture 30. Aperture 30 is best shown in FIG. 8. In this embodiment of the present invention, the securing of the panel element 18 is accomplished when stake 28 is inserted into aperture 30. Securing of panel element 18 can be accomplished during the insertion by a snap fit arrangement as shown in FIG. 13, or by use of a separate fastener 46 engageable with the stake 28 as shown in FIG. 11, or by thermally deforming stake 28 after insertion as shown in FIG. 10. If thermal deformation is the method chosen, stake 28 is known in the art as a "heat stake".

Figure 4:
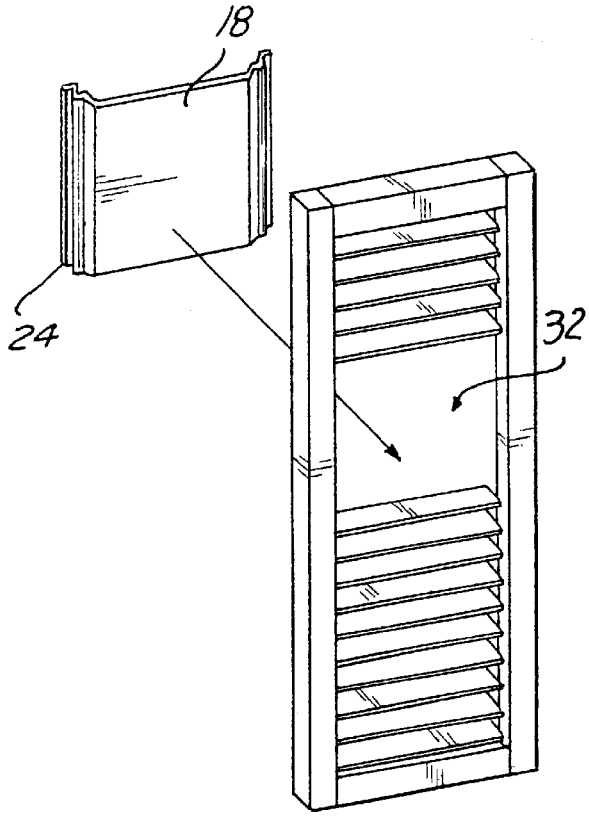
FIG. 4 is an exploded view of a second embodiment of the invention wherein elements are inserted through an aperture cut in the base shutter.
Figure 6:
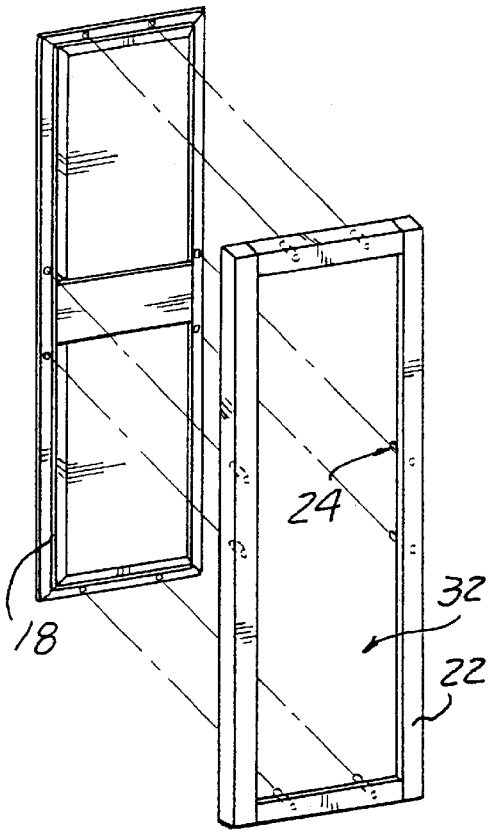
FIG. 6 is an exploded view of an embodiment of the invention wherein a full-length panel element is attached to the base shutter by stakes formed on the frame.

The shutter assembly 10 can also be assembled by removing a quantity of louvers 16 from the base shutter 20. Preferably, the louvers 16 are removed from the base shutter 20 by cutting a portion of the louvers 16 out of the frame 22. When the louvers 16 are removed, a gap 32 is created in the base shutter 20, as best illustrated in FIG. 4, 6, or 8. Once the gap 32 has been formed, the panel element 18 is inserted into the base shutter 20 from a rear or front side of the base shutter 20. As used herein, the "rear side of the base shutter" is the side that is hidden from view when the shutter assembly 10 is mounted next to a window. As used herein the "front side of the base shutter" is the side that is visible when the shutter assembly 10 is mounted next to a window.

Figure 5:
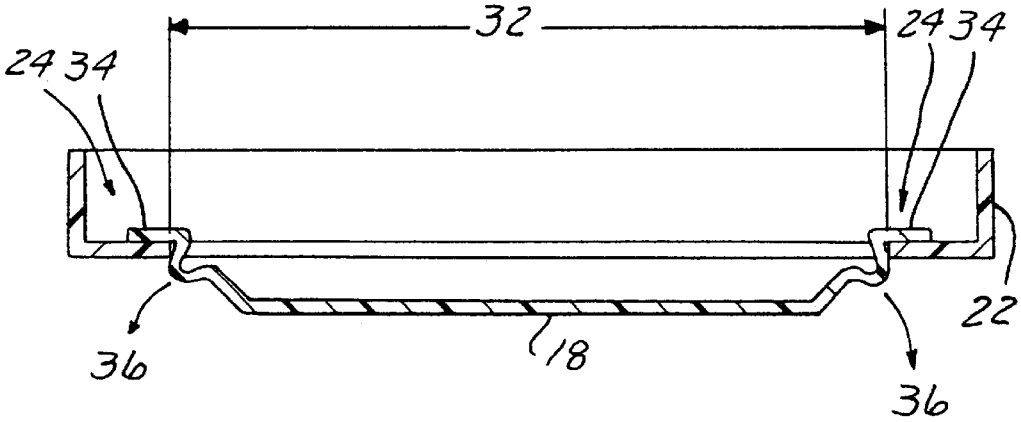
FIG. 5 is a cross-sectional view of the shutter assembly of FIG. 4.
Figure 7:
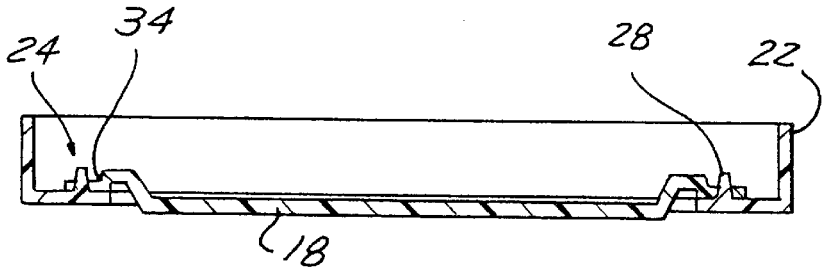
FIG. 7 is a cross-sectional view of the shutter assembly of FIG. 6.

In embodiments of the present invention wherein one or more louvers 16 are removed to form gap 32, the panel element 18 can be secured to the base shutter 20 in several alternative ways. Preferably, panel element 18 includes a projection 24. Furthermore, the projection 24 can take the form of a lip 34. The lip 34 can extend from the panel element 18 in a generally tangential direction as best seen in FIG. 5. FIGS. 7 and 9 show an alternative variation on lip 34. The lip 34 can support an aperture 30, or a stake 28, or any combination thereof for connecting with complementary structure on the frame 22.

FIG. 5 shows one embodiment of the present invention incorporating a gap 32 between the frame 22 and a panel element 18 including a lip 34. In this variation of the present invention, panel element 18 is inserted through gap 32 and, preferably, is slightly deformed. This deformation creates a resiliency force in the direction of arrow 36 and a snap fit between panel element 18 and frame 22 is achieved. Lip 34 acts to prevent panel element 18 from completely passing through frame 22.

Figure 12:
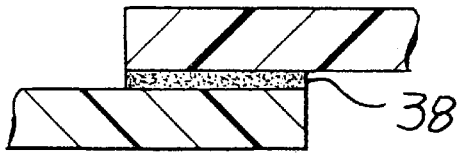
FIG. 12 is a cross-sectional view of the shutter assembly showing the engagement of the panel element and the base shutter with adhesive or ultrasonic spot weld.

The panel element 18 can be formed such that a snap fit with frame 22 is not achieved. Specifically, the panel element will be formed such that its width, excluding the lip 34, is equal to or less than the width of gap 32. In such an embodiment, the panel element 18 can be secured to the frame 22 through the use of ultrasonic spot welding or adhesive 38 as best seen in the detail of FIG. 12.

In another embodiment of the present invention employing a gap 32, the frame 22 can include a stake 28. Furthermore, in such an embodiment the lip 34 of the panel element 18 can include an aperture 30. The securing of the panel element 18 to the frame 22 is functionally identical to the method described above. The stake 28 is inserted into aperture 30, aperture 30 now being part of panel element 18. The insertion can create a snap fit arrangement for stake 28, as shown in FIG. 13. In addition, or alternatively, the stake 28 can be thermally deformed as shown in FIG. 10. The present invention can also be practiced in a third embodiment. The panel element 18 can include a lip 34. The base shutter 20 can be unmodified (i.e., no gap 32). In such an embodiment, the panel element 18 is secured to the front of the base shutter 20 through the use of ultrasonic spot welding or adhesive 38 as shown in the detail of FIG. 12. The panel element 18 is positioned at a desired location along the frame 22, spot welding is performed or adhesive 38 is positioned on one side, front or rear, of the lip 34, and the panel element 18 is pressed against the frame 22. The securing of the panel element 18 to the frame 22 through the use of a stake 28 and aperture 30 can also be accomplished wherein a separate fastener 46 is used, as best shown in FIG. 11.

The shutter assembly 10 of the present invention can be practiced with a combination element 40, as best seen in FIG. 8. The combination element 40 is a variant of the standard panel element 18. In FIG. 8, a combination element 40 having a flat planer section 42 and a louvered section 44 is shown. All of the securing methods detailed above are generally applicable to the combination element 40. Combination element 40 can include a projection 24, or a retainer 26, or a lip 34 or any combination thereof for attaching to the base shutter 20. Projection 24 can extend from combination element 40 at the flat planar section thereof.

The present invention also teaches a method of constructing a shutter assembly 10. A base shutter 20 is provided, having a frame 22 and a plurality of transversely extending louvers 16. A set of panel elements 18 of different sizes and appearances are provided. At least one panel element 18 of the set is selected, and secured to the base shutter 20. The panel element 18 can be secured at any position along the frame 22 of the base shutter 20. The method taught by the present invention can be practiced wherein the panel element 18 is substantially longer than the width of the frame 22. This arrangement is shown in FIG. 2, wherein panel element 18 is clearly longer than a cross-section of frame 22 is wide. The method of the present invention can be practiced wherein the panel element 18 includes at least one projection 24 extending from a surface thereof, such as stake 28 extending from the rear surface of the panel 18, or alternatively from the rear surface of the base shutter 20. In this embodiment of the invention, the panel element 18 covers a plurality of louvers 16.

Alternatively, the present invention can be practiced wherein louvers 16 are removed from the base shutter 20 and the panel element 18 is inserted through the gap 32 created therein. FIG. 6 shows one example, albeit an extreme example, of the present invention. All the louvers 16 have been removed from the base shutter 20 leaving essentially only a frame 22. The panel element 18 is inserted into frame 22 and completely occupies the space between the sides of the frame 22.

The flexibility in the manufacture of shutter assemblies provided by the present invention allows for an infinite variety of shutters to be produced. Certainly, all of the possible variations are not detailed in this specification.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A shutter assembly having at least one louvered section and at least one raised panel section, comprising:

a plastic molded base shutter having a frame forming the periphery of the base shutter and a plurality of transversely extended louvers, each louver having a rearward first edge and a forward second edge; and a set of plastic molded panel elements of different sizes and appearances with respect to the base shutter, each panel element securable within the frame to said base shutter to define said at least one raised panel section at a desired location wherein said louvers and said frame of said base shutter are integrally molded as a single unitary piece, and wherein each panel element comprises at least one projection from a rear surface thereof, said projection having a downwardly bent end for securing over the rearward first edge of one of the louvers to hold each said panel element in a desired position in front of and covering a plurality of the louvers.

2. The shutter assembly of claim 1 wherein at least one of the panel elements is substantially longer than the width of said frame.

3. The shutter assembly of claim 1 wherein said at least one projection engages at least one louver of said base shutter in a snap fit arrangement.

4. The shutter assembly of claim 1 wherein said frame of said base shutter further comprises at least one through aperture at a desired location and wherein said at least one projection of said panel element engages said base shutter through said through aperture in a snap fit arrangement.

5. The shutter assembly of claim 1 wherein said frame of said base shutter further comprises at least one through aperture at a desired location and wherein said at least one projection of said panel element engages said base shutter through said through aperture and is thermally deformed after engagement.

6. The shutter assembly of claim 1 further comprising said panel element having a lip securable against one side of said frame with adhesive.

7. A shutter assembly having at least one louvered section and at least one raised panel section, comprising:

a plastic molded base shutter having a frame forming the periphery of the base shutter and a plurality of transversely extending louvers; and a set of plastic molded panel elements of different sizes and appearances with respect to the base shutter, each panel element securable within the frame to said base shutter to define said at least one raised panel section at a desired location wherein said louvers and said frame of said base shutter are integrally molded as a single unitary piece, wherein said panel element is attached to said base shutter by forming a gap in said louvered section at a desired location and inserting said panel element though said gap from a rear side of said base shutter.

8. The shutter assembly of claim 7 further comprising said panel element having a lip engageable with said frame in a snap fit arrangement.

9. The shutter assembly of claim 7 further comprising said panel element having a lip securable against said rear side of said frame with ultrasonic spot welding.

10. A shutter assembly having at least one louvered section and at least one raised panel section, comprising:

a plastic molded base shutter having a frame and a plurality of traversely extending louvers, wherein said louvers and said frame of said base shutter are integrally molded as a single unitary piece;

a set of plastic molded panel elements of different sizes and appearances with respect to the base shutter, each panel element securable to said base shutter to define said at least one raised panel section at a desired location, wherein said panel element is attached to said base shutter by forming a gap in said louvered section at a desired location and inserting said panel element through said gap from a rear side of said base shutter;

said frame having at least one stake extending out from said rear side of said base shutter; and said panel element having at least one aperture in a desired location, said at least one stake in said base shutter engageable with said at least one aperture in said panel element in a snap fit arrangement.

11. A shutter assembly having at least one louvered section and at least one raised panel section, comprising:

a plastic molded base shutter having a frame and a plurality of traversely extending louvers, wherein said louvers and said frame of said base shutter are integrally molded as a single unitary piece;

a set of plastic molded panel elements of different sizes and appearances with respect to the base shutter, each panel element securable to said base shutter to define said at least one raised panel section at a desired location, wherein said panel element is attached to said base shutter by forming a gap in said louvered section at a desired location and inserting said panel element through said gap from a rear side of said base shutter;

said frame having at least one stake extending out from said rear side of said base shutter; and said panel element having at least one aperture in a desired location, said at least one stake in said base shutter engageable with said at least one aperture in said panel element and thermally deformed after engagement.

12. A method of constructing a shutter assembly having at least one louvered section and at least one raised panel section, comprising the steps of:

providing a plastic molded base shutter having a frame forming the periphery of the base shutter and a plurality of transversely extending louvers wherein said louver and said frame are integrally molded as a single unitary piece and wherein each louver has a rearward first edge and a forward second edge;

providing a set of plastic molded panel elements of different sizes and appearances with respect to the base shutter, said panel elements having at least one projection projecting from a rear surface thereof, the projection having a downwardly bent end; and securing at least one selected panel element from the set to the base shutter at a desired location on the base shutter by securing the downwardly bent end of the projection over the rearward first edge of one of the louvers to define said at least one raised panel section.

13. The method of claim 12 wherein at least one of said panel elements is substantially longer than a width of said frame.

14. The method of claim 12 wherein the securing step further comprises the step of:

forming a gap in said base shutter and inserting the panel element through said gap from a rear side of said base shutter.

15. The method of claim 14 wherein said frame has at least one stake, and said panel element has at least one aperture, and said securing step further comprises the step of inserting said at least one stake through said at least one aperture such that a snap fit connection results between the frame and the panel element.

* * * * *